United States Patent [19]

Aghnides

[11] Patent Number: 4,534,514

[45] Date of Patent: Aug. 13, 1985

[54] CONCEALED AERATOR WHICH SEALS AGAINST A SPOUT WHEN INSERTED THEREIN

[76] Inventor: Elie P. Aghnides, Hotel Pierre, 795 Fifth Ave., New York, N.Y. 10021

[21] Appl. No.: 532,289

[22] Filed: Sep. 15, 1983

Related U.S. Application Data

[63] Continuation-in-part of Ser. No. 457,775, Jan. 13, 1983.

[51] Int. Cl.[3] ..... E03C 1/08

[52] U.S. Cl. ..... 239/428.5

[58] Field of Search ..... 239/288–288.5, 239/428.5, DIG. 18; 261/DIG. 22

[56] References Cited

U.S. PATENT DOCUMENTS

| | | | |
|---|---|---|---|
| 3,014,667 | 12/1961 | McLean et al. | 239/428.5 |
| 3,067,951 | 12/1962 | Aghnides | 239/428.5 |
| 3,270,965 | 9/1966 | Aghnides | 239/428.5 |
| 3,279,702 | 10/1966 | Aghnides | 239/428.5 |
| 3,298,614 | 1/1967 | Aghnides | 239/428.5 |
| 3,363,841 | 1/1968 | Aghnides | 239/428.5 |
| 3,635,405 | 1/1972 | Shames et al. | 239/428.5 |
| 3,827,636 | 8/1974 | Parkison et al. | 239/428.5 |

FOREIGN PATENT DOCUMENTS

| | | | |
|---|---|---|---|
| 428595 | 7/1967 | Switzerland | 239/428.5 |
| 986142 | 3/1965 | United Kingdom | 239/428.5 |
| 1189550 | 4/1970 | United Kingdom | 239/428.5 |

*Primary Examiner*—Andres Kashnikow
*Attorney, Agent, or Firm*—William D. Hall

[57] ABSTRACT

An aerator for introducing air into a liquid flowing under pressure through a spout, the aerator being partially or totally concealed by the spout and being substitutable—in dimensions and flow characteristics—with a conventional, unconcealed aerator having standard male threading. The concealed aerator is couplable to a spout having female threading at the most downstream portion thereof and provides enhanced sealing between the concealed aerator and spout. Specifically, for a concealed aerator including two concentric tubular members with an air space therebetween, the present invention teaches the forming of a seal between the upstream surfaces of both tubular members against an annular shelf defined within the spout.

18 Claims, 16 Drawing Figures

FIG. 11
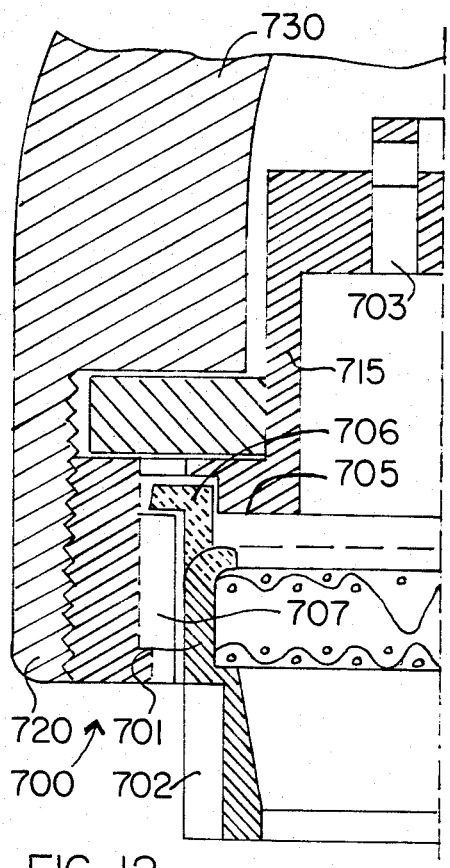
FIG. 13
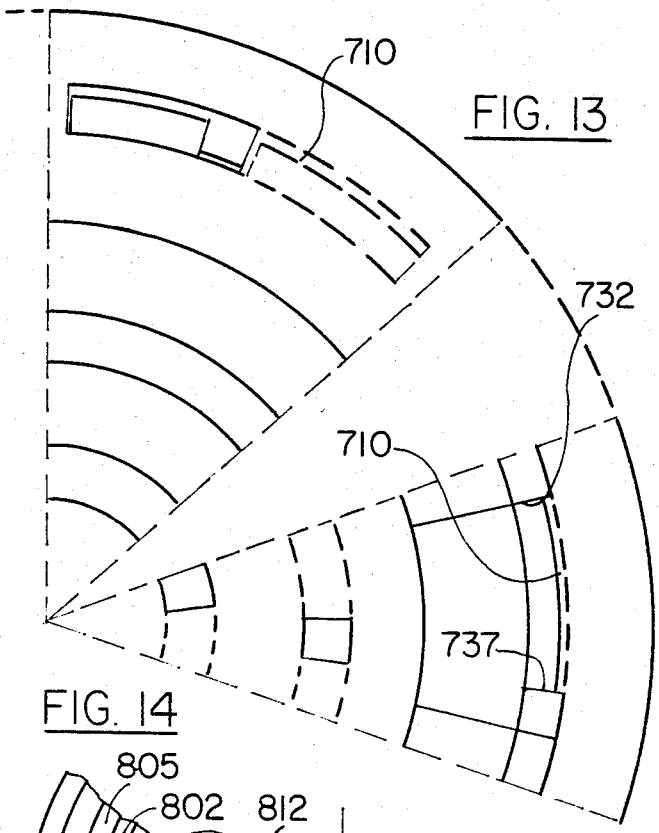
FIG. 14
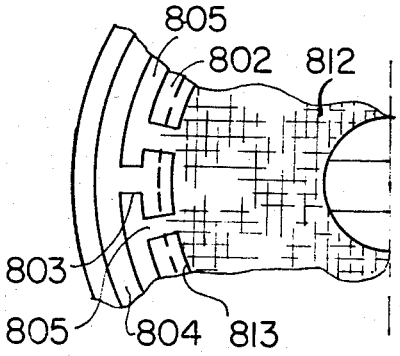
FIG. 16
FIG. 12
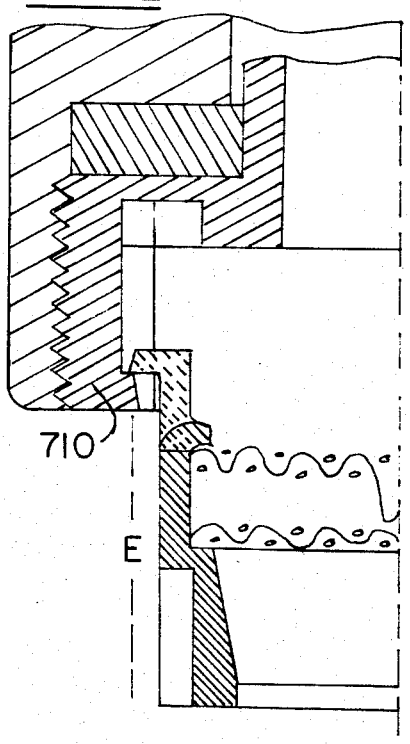
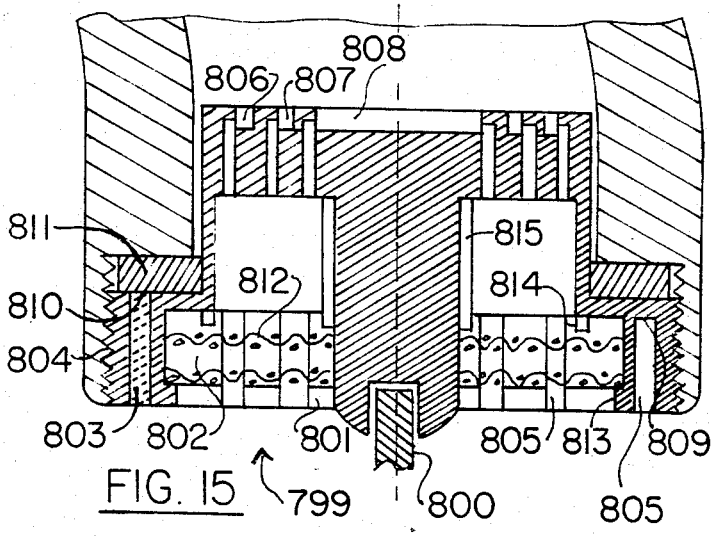
FIG. 15

CONCEALED AERATOR WHICH SEALS AGAINST A SPOUT WHEN INSERTED THEREIN

RELATED CASES

This is a continuation-in-part of U.S. patent application Ser. No. 457,775 filed on Jan. 13, 1983 which is a continuation-in-part of PCT application Ser. No. PCT/US-81-01341 filed on Oct. 2, 1981, now No. WO83/01266 and entitled Concealed Liquid Flow Aerator invented by Elie P. Aghnides.

DESCRIPTION

1. Technical Field

The present invention relates to aerators insertable into a female threaded spout.

2. Background Art

In the past, aerators that are insertable into the end of a spout through which liquid under pressure flows have been designed in various ways to be concealed within the spout. The present inventor has, in fact, taught numerous concealed aerators in certain of his foreign and U.S. patents.

In United Kingdom Pat. No. 1,189,550, FIGS. 4 through 7 illustrate concealed aerators. In each depicted embodiment in the UK patent, the aerator is threaded at its upstream end and does not show a spout which is female threaded at the most downstream portion. A large portion of commercial aerators are not concealed and are coupled to the female threading of a spout at the most downstream portion thereof. Accordingly, the aerators shown in UK Pat. No. 1,189,550 have not been substitutable with a number of commercial aerators of the unconcealed variety. In addition, the outer diameters of the aerators of the prior British patent were not specified as having standard male threads, corresponding to those of common conventional unconcealed aerators, thus further underscoring the lack of substitutability of the concealed aerators and known unconcealed aerators. Further, the British patent does not teach the extending of the aerator upstream from the threading and, hence, does not teach an upstream portion of smaller diameter than the threaded downstream portion of the aerator. Thus, although useful and valuable in its intended illustrated embodiments, the invention pictured in UK Pat. No. 1,189,550 lacked substitutability in various instances.

In U.S. Pat. No. 3,067,951 an at least partly concealed Aghnides aerator is disclosed. As in the British patent, this U.S. patent does not teach an unthreaded upstream extension. The entire length of the concealed portion of this prior aerator is threaded and coupled to the length of female threading in the spout. Like UK Pat. No. 1,189,550, this patented embodiment does not house any portion of the aerator above the threaded portion of the aerator and is, to that extent, limited in application.

U.S. Pat. No. 3,298,614, also to Aghnides, shows a concealed aerator in FIG. 5 which does extend upward into the spout beyond the threading. However, this embodiment relies on only the threading to achieve sealing and does not show the aerator of FIG. 5 inserted into a spout having a smaller inner diameter upstream from the threaded spout end.

It is noted that the UK Pat. No. 1,189,550 teaches an annular shoulder (28) of transverse wall (13) which abuts the spout (25). In Aghnides '951 a perforated disc (61) abuts the spout (60). However, in both instances the internal structure of the aerator contacts the spout.

Pressure is thus applied to the transverse wall or disc upon insertion of the aerator.

Finally, U.S. Pat. No. 3,014,667 to McLean et al illustrates in FIG. 9 a flow control device in an aerator. The McLean device does not teach an aerator insertable into a spout threaded at its most downstream end. The McLean et al device also clusters the aerator (82) downstream from the threads, while a flow control element (84) is coupled to the aerator and placed upstream of the threads. McLean et al do not disclose how to extend an aerator upward into a smaller diameter portion of a spout in order to achieve concealment thereof, or to increase flow length in the aerator, when the aerator is coupled to threads at the most downstream portion of the spout. Accordingly, substitutability with standard threaded, unconcealed aerators is not sought. That is, as with other prior concealable aerators, the McLean et al device does not indicate that its male threading conforms to the standard threading of unconcealed aerators.

In reviewing the above references, it is thus noted that the prior patents (a) do not feature aerator substitutability in size and (b) do not provide sealing by an element carried on an annular ledge formed by the interfacing of the upstream portion and threaded downstream portion of an aerator—the downstream portion having a larger outer diameter.

It is also noted that the prior references do not provide the structure or dimensions of elements for a concealed aerator which would yield the same flow characteristics of a conventional unconcealed aerator. This is, of course, significant where various governments have provided regulations controlling flow characteristics. McLean et al employ a separate flow control element, but do not discuss how to define substitutable flow characteristics with the aerator alone. None of the references specify the relative dimensions of the spout and aerator required for such substitutable flow and none provide for a jet forming element with longitudinal channels therethrough where the channels discreetly increase in cross-section downstream in order to achieve conventional flow characteristics.

Further, the references which do not extend the aerator length also do not allow for a screen in the aerator to be displaced longitudinally upward and downward when a coin—used for screwing and unscrewing the aerator—is inserted into the lower end of the aerator.

In examining various prior aerators, one will note that sealing the aerator when inserted in a spout is a significant feature. Typically, an aerator includes one tubular member which abuts the end of the spout or a shelf along the interior of the spout at a location where the spout reduces in diameter in the upstream direction. In some instances, an inner tubular member is encircled by an outer tubular member with an air gap therebetween; however, as shown in U.S. Pat. No. 3,270,965, only the inner tubular member seals against the spout. Although satisfactory in some applications, it has been found that such sealing may not be adequate with some aerator designs which embody inner tubular members encircled by outer tubular members, especially in a concealed or partly concealed embodiment. To prevent water leaking downstream into an air channel between the two concentric tubular members and to prevent air leaking upstream, the forming of a tight seal is a distinct benefit in an aerator.

DISCLOSURE OF INVENTION

The present invention is directed to a partially or fully concealed aerator which is screwably coupable to female threading at the most downstream portion of a spout. Through the spout fluid to be aerated flows under pressure. According to the invention, the female threading is a standard threading which corresponds to conventional, unconcealed aerators. Upstream from the female threading of the spout is an upstream pipe portion of smaller inner diameter than the female threaded downstream pipe portion of the spout. The present aerator is dimensioned to fit in such a spout, the aerator having standard male threading and having a reduced diameter upstream therefrom. It is thus an object of the invention to provide a concealed aerator which fits into a spout which can also accommodate a standard, unconcealed aerator.

In addition, it is an object of the invention to enhance sealing of the substitutable concealed aerator against the spout by defining an annular ledge interfacing between the upstream unthreaded portion and downstream threaded portion of the aerator and including an annular sealing element on the ledge. Inasmuch as in the United States and abroad the threading of most existing and new faucets is at present standard female threads having an inner diameter of 23.00 mm. (13/16/27 TPI), an object of the invention is the creation of an aerator having male threads which will fit said standard female threads and which is partially or entirely concealable, to permit easy replacement of old aerators and to avoid any changes with regard to said female threads and to the dimensions upstream said threads in the manufacture of new faucet spouts.

In aerators entirely concealed, it is also an object of the invention to provide effective means for screwing the aerator to and from the spout. Indents are provided at the bottom of the aerator into which a coin is insertable. When inserted, the coin enters a longitudinal cavity within the aerator. A screen contained in a shell is either (a) pushed upward in the cavity by the coin during insertion thereof, the screen returning to a lower position when the coin is removed, or (b) fixedly coupled far enough upstream in the cavity so that the coin is insertable without contacting the shell containing the screen. In the first instance, means are provided for limiting the downstream travel of the shell.

In one embodiment, the invention is a totally concealed aerator. In another embodiment, a "partially" concealed aerator is provided. In this invention, "partially" concealed means that the aerator includes (a) a male threaded portion which is screwable into female threading at the most downstream pipe portion of a spout, (b) an unthreaded portion upstream from the male threaded portion, and (c) an unthreaded portion downstream from the male threaded portion, wherein only the unthreaded downstream portion is not concealed.

To further facilitate fabrication, assembly, and installation and to decrease cost, the aerator is formed of molded plastic—various portions of the aerator being combined into an integral structure. Also, in a specific embodiment, the plastic may be transparent with metal interspersed therein if desired.

Further, in a specific embodiment of a partially concealed aerator, the unthreaded downstream portion is contained within a metal sleeve or housing which, to cover a conventional aerator, would have to be twice as big and cost correspondingly more. Also in the partially concealed aerator form of the invention, it is preferred that the inner diameter of the portion of the aerator downstream from the threading exceed the inner diameter of the portion upstream from the threading. This achieves the object of enhanced flow characteristics.

Still further, one embodiment of the invention includes an inner tubular member with windows therein and an outer tubular member with air channels therein, the concentric members being spaced apart and coupled by arcuate members positioned in the space therebetween at angular intervals. Between adjacent arcuate members is air space which connects the air channels to the windows to provide an air passageway from outside the aerator into a chamber circumscribed by the inner tubular member. The inner tubular member has an upstream surface and the outer tubular member has an upstream surface. To close off the air space between the two concentric members, a washer lies on the upstream surface of the inner tubular member and on the upstream surface of the outer tubular member, the washer covering the air space between the two members. When the aerator is screwed into the spout, the washer is pressed between a shelf within the spout and the respective upstream surfaces of the inner tubular member and the outer tubular member. Further, in this embodiment, a disc with apertures therein is disposed upstream of the inner tubular poriton, the disc being dimensioned to fit within an upstream pipe portion of the spout that has a reduced diameter relative to the downstream end of the spout which is female threaded. The inner tubular portion has a larger diameter than the disc and is preferably larger than the reduced diameter of the upstream pipe portion of the spout. To further enhance sealing, the washer is dimensioned so that its inner peripheral surface seats against the outer peripheral surface of the disc when the washer is pressed between (a) the annular shelf of the spout (i.e. where the spout diameter changes) and (b) the two upstream surfaces. Accordingly, a tight seal for an aerator that is at least partly concealed—with at least part of the disc positioned upstream of the female threading in the upstream pipe portion of the spout—and includes concentric inner and outer tubular members is provided.

BRIEF DESCRIPTION OF THE DRAWINGS

In FIG. 1 an annular sealing washer is provided between the aerator and the spout; FIG. 4 illustrates an alternative in which an annular ridge extending upward from the aerator provides a sealing function in addition to the sealing effected by the coupled threading.

FIGS. 11 through 14 illustrate another embodiment of the present invention. FIGS. 11 and 12 represent partial front cutaway views with the screen held at differing heights. FIGS. 13 and 14 represent partial top and partial bottom views, respectively.

FIG. 15 is a front cutaway view of a further embodiment. FIG. 16 is a partial bottom view of the aerator of FIG. 15.

BEST MODE FOR CARRYING OUT THE INVENTION

Figure 1:
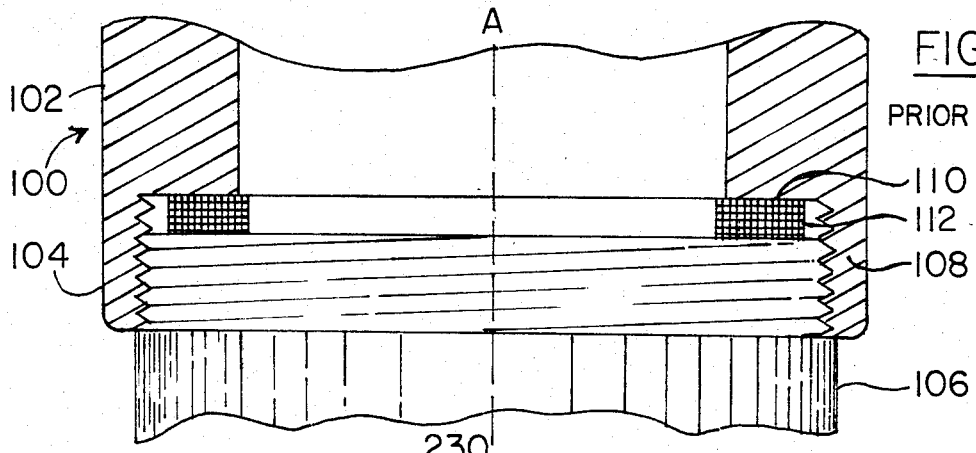
FIG. 1 PRIOR ART
FIG. 1 is an illustration of a prior art unconcealed aerator which is inserted in a spout of a given diameter.

Referring to FIG. 1, a spout (100) is shown having an upstream portion (102) and a female threaded downstream pipe portion (104). The female threaded portion (104) has a standard female threading of approximately 23.5 mm. Shown inserted into the most downstream portion of (104) is a conventional, unconcealed aerator (106) having a standard male threading (108) which is complementary with the female threading at the spout end. That is, the male threading (108) has an outer diameter of approximately 23.5 mm. Examining the upstream pipe portion (102) of the spout (100), it is noted that the inner diameter thereof is significantly less than the inner diameter of the female threading provided along the inner surface of the downstream pipe portion (104). In this regard it is noted that an annular surface (110), which is transverse to the longitudinal axis A of the spout (100), is defined along the inner contour of the spout (100). To provide sealing of the conventional, unconcealed aerator (106), an annular washer (112) is provided. Hence, the annular washer (112) provides one measure of sealing and the threading provides a second measure of sealing.

Figure 2:
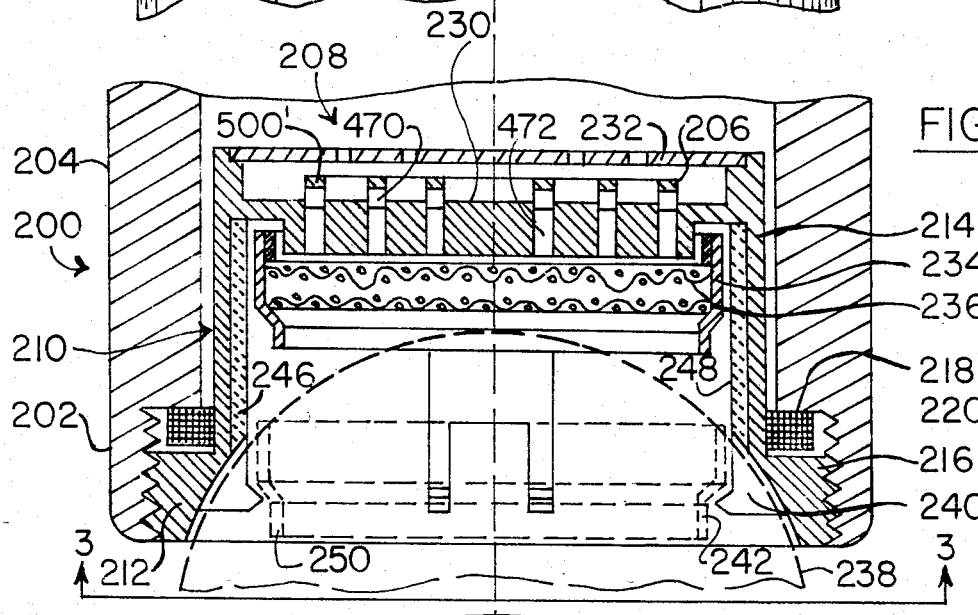
FIG. 2 is an illustration of a fully concealed aerator which is insertable into a spout having standard female threading at its most downstream portion.

Referring now to FIG. 2, a spout (200) is illustrated. The female threading at the most downstream portion (202) is the same as that shown in FIG. 1. However, it is noted that the inner diameter of the upstream portion (204) is increased relative to the inner diameter of the spout shown in FIG. 1. This permits a greater inflow of water to an inlet element (206) at the upstream entrance to a totally concealed aerator (208). As will be noted below, the dimensions of the concealed aerator (208) shown in FIG. 2 are significant in that they permit the concealed aerator (208) to not only fit within the standard female threading at the end of a spout, but also to achieve flow characteristics for the concealed aerator (208) comparable to the flow from the conventional, standard unconcealed aerator (106) shown in FIG. 1.

The totally concealed aerator (208) of FIG. 2 includes a tubular element (210) which extends the length of the concealed aerator (208). The tubular element (210) also includes a second tubular length (214), which is unthreaded and extends upstream of the threaded portion (202). The second tubular length (214) has an outer diameter which is less than the outer diameter of the threads of the first tubular length (212). Interfacing and extending between the outer surface of the first tubular length (212) and the second tubular length (214) is an annular ledge (216). Due to the aerator structure, an annular sealing element (218) can be placed against the annular ledge (216). When the concealed aerator (200) is screwed into the spout end, the annular sealing element (218) presses against an annular transverse surface (220) which is formed as discussed with reference to FIG. 1, where the female threaded pipe portion (202) meets the upstream pipe portion (204) which is of smaller diameter. In this regard, it should be noted that the inner diameter of the upper pipe portion (204) is maximized. That is, although less than the inner diameter of the female threaded pipe portion (202), the inner diameter of the upstream pipe portion (204) is made as large as possible, provided that the annular sealing element (218) fits between the spout (200) and aerator (208). Generally, said pipe portion (204) is on the order of 17.5 mm and the concealed aerator (208) may have only two rows of chambers and a smaller screen outlet diameter without impairing aeration. In most U.S. states a flow rate as low as 2.5 GPM at 80 lbs. back pressure is recommended and in California it is compulsory. The above-mentioned dimensions achieve the recommended or compulsory flow characteristics.

Referring again to the structure of the aerator (208) shown in FIG. 2, the liquid inlet element (206) is shown having a jet forming means (230) over which is placed a perforated disc (232). The perforated disc (232) restricts the inflow of liquid to the concealed aerator (208), while the jet forming means (230) forms the inflow of water thereto into a plurality of streamlets. Below the jet forming means (230) is a shell (234) which contains a screen (236) through which the streamlets from the jet forming means (230) pass. Examining the shell (234) which contains the screen (236), it is noted that the screen-and-shell assembly is movable longitudinally within the interior of the concealed aerator (208). Specifically, when a coin (238) is inserted into indents (240) at the downstream end of the concealed aerator (208), the shell-and-screen assembly is forced upstream. That is, normally the shell (234) which contains the screen (236) rests at the downstream end of the concealed aerator (208) as suggested by the dashed representation of the shell indicated by the numeral (242). Insertion of the coin (238) causes the shell (234) to travel longitudinally upstream as shown by the solid representation of the shell (234). Accordingly, it is noted that there is a cavity in the interior of the aerator (208). This cavity is formed by the substantially cylindrical inner wall (246) of the tubular element (210) and a plurality of longitudinal ribs (248) which are spaced at various angular positions around the inner periphery of the wall (246). At the downstream end of the ribs (248) are prongs (250) which, as seen in FIG. 2, confine the downstream travel of the shell (234). Specifically, the shell (234) is dimensioned to abut the prongs (250) when in its downstream normal position (242).

Figure 3:
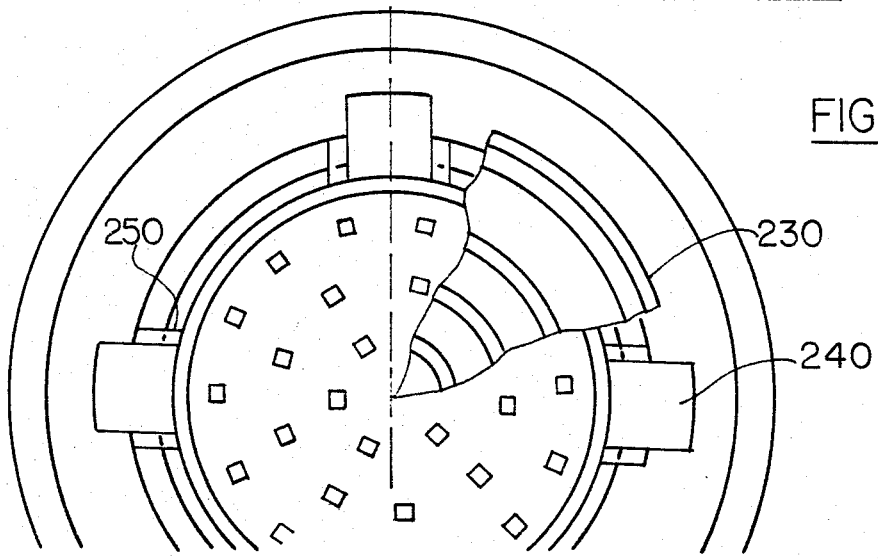
FIG. 3 is a part-cutaway bottom view of the aerator shown in FIG. 2 taken along line 3—3.

Referring to FIG. 3, the prongs (250) are shown from a bottom view and the indents (240) into which the coin (238) is inserted are shown in cutaway. It is, of course, recognized that the indents (240) are preferably at diametrically opposite points at the lower portion of the concealed aerator (208). In addition, there may be several pairs of such indents into which a coin (238) may be inserted. The cutaway portion, it is noted, shows the jet forming means (230) in partial view.

Figure 4:
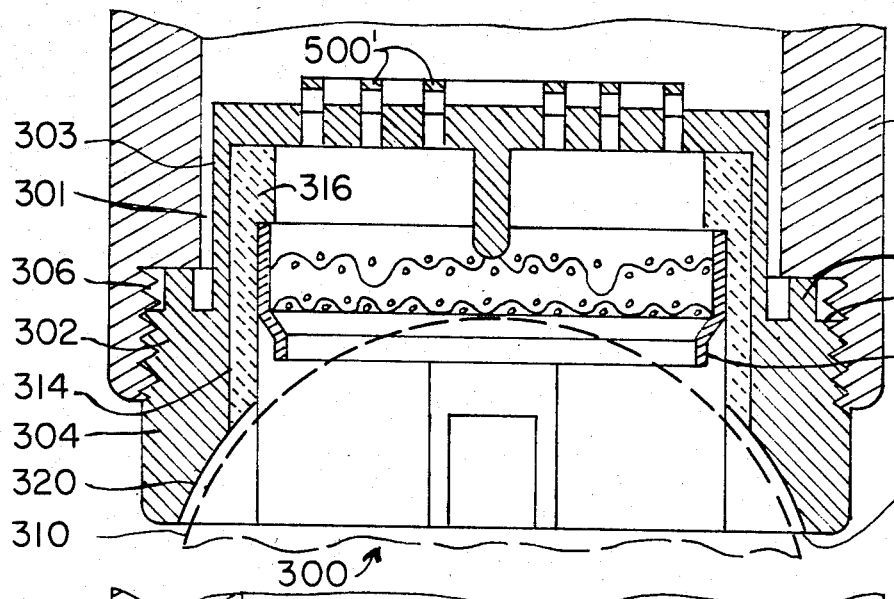
FIG. 4 is an illustration of a partially concealed aerator.

Referring now to FIG. 4, a partially concealed aerator (300) is shown. Specifically, the aerator (300) includes a tubular element (301) which includes a first tubular length (302), a second tubular length (303) and a third tubular length (304). The partially concealed aerator (300), like the aerators in FIGS. 1 and 2, is structured to fit into a spout (305) having a downstream pipe portion (306), which is threaded with standard female threading and an upstream pipe portion (307) which has an orifice of diameter less than that of the female threaded portion (306) but, nonetheless, maximized to the greatest extent possible. The first tubular element (302) is shown having standard male threading (such as the 23.5 mm diameter previously noted). Extending upstream from the first tubular length (302) is the second tubular length (303) which is unthreaded and has a diameter which is less than the outer diameter of the first tubular length (302). Extending downward from the first tubular length (302) is the third tubular length (304) which is shown to have an outer and inner diameter preferably greater than that of the second tubular length (303).

As in the FIG. 2 embodiment, the aerator (300) of FIG. 4 can be inserted by screwing the aerator (300) into the spout by using a coin (310). In the FIG. 4 embodiment, a screen-containing shell (312) is forcefit into the interior of the aerator (300) at an upstream position. It is seen that the inner wall (314) of the tubular portion (301) has coupled thereto peripheral member (316) to which the screen-containing shell (312) can be fixedly coupled. It is noted that the shell (312) is recessed sufficiently from the downstream end of the partially concealed aerator (300) to permit the insertion of the coin (310). As previously noted, the coin (310) is inserted into indents (320) provided at preferably diametrically opposite positions at the downstream end of the partially concealed aerator (300). In FIG. 4, it is noted that the annular washer (318) shown in FIG. 2 is replaced by an annular ridge (322) extending upward from the annular ledge (324) which interfaces and extends between the threading of the first tubular length (302) and the outer surface of the second tubular length (303).

The embodiment shown in FIG. 4 is a longer aerator than that shown in FIG. 2. This embodiment is used when the spout (305) is not enough above the threaded portion (306) to accommodate an aerator such as that shown in FIG. 2. In the FIG. 4 embodiment the second tubular length (303) can have an outer diameter of approximately 20 mm, to fit within a spout (305) which is correspondingly dimensioned.

Figure 5:
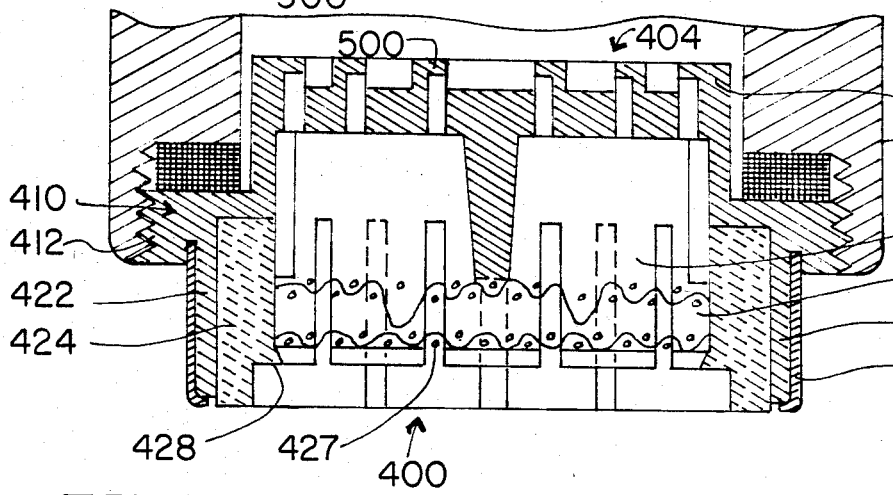
FIG. 5 is an illustration of another partially concealed aerator.

Referring now to FIG. 5, a partially concealed aerator (400) is illustrated in which the upstream pipe portion (402) of spout (403) is not maximized. That is, the spout (403) has the same dimension as that shown in FIG. 1, which is conventionally provided.

As in FIG. 4, a tubular element (410) in the FIG. 5 embodiment includes a first length (412), a second length (416) and a third length (418), the first length (412) having standard male threading and being interposed between the unthreaded second tubular length (416) which is upstream therefrom and the unthreaded third tubular length (418) which is downstream therefrom. The third tubular length (418), if desired, can be encased or housed in a metal sleeve (420). Along the inner wall (422) of the tubular length (410) are a plurality of longitudinal ribs (424). Contained within the ribs are longitudinally extending curtains (426) having longitudinal slits (427) therebetween. The curtains (426) encircle the screen (406), air entering the slits (427) between the curtains (426) to provide aeration of the liquid passing through the screen (406). The screen (406) is held in place by prongs (428) which project inwardly from the ribs (424) at the downstream end thereof. The slits (427) are large enough to permit air to flow in but not sufficiently large that water flows out therefrom. As an alternative to the prongs (428) the screen (406) may be coupled in place by ultrasonic treatment or other means.

As an alternative, the wall 418 of FIG. 5 may be eliminated and the sleeve 420 may directly encircle the ribs 424. The downstreammost end of the sleeve 420 is then turned inwardly sufficiently to form a desired tubular outlet orifice which guides the bubbly stream discharging from the aerator 400. By increasing the spacing between ribs 424, a larger inflow of air can be made to enter the aerator 400 between the ribs 424.

Figure 7:
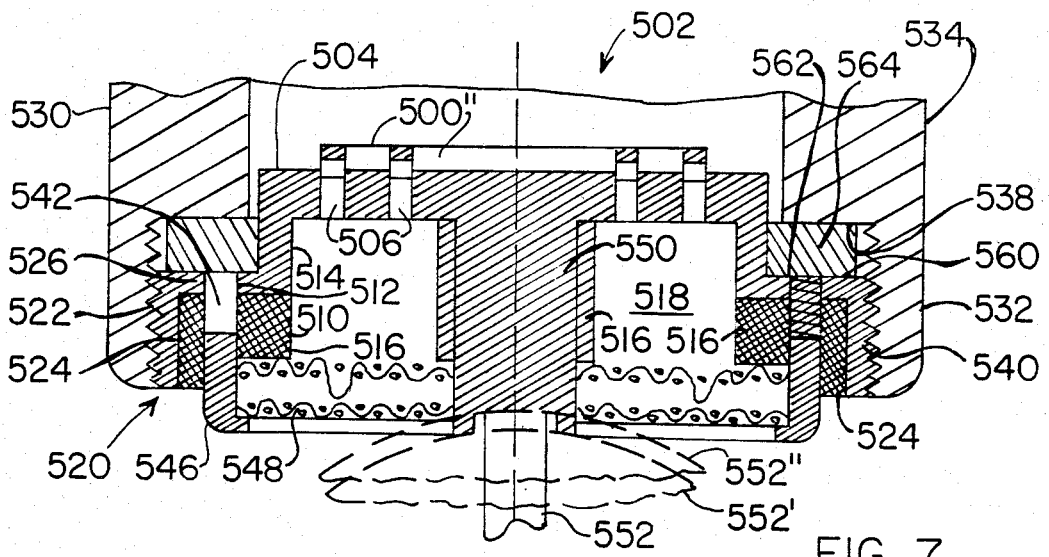
FIG. 7 is a front cutaway view of a partly concealed aerator including two concentric, spaced apart tubular members, the left half of the view being taken along line AB of FIG. 9 and the right half of the view being taken along line BC.

In examining FIG. 5 further, it may be noted that bridge elements 500 therein differ from the bridge elements in FIGS. 2,4, and 7 in that elements 500 permit water to flow in only one side of each bridge element 500. The type of bridge element may be interchanged as desired.

Figure 6:
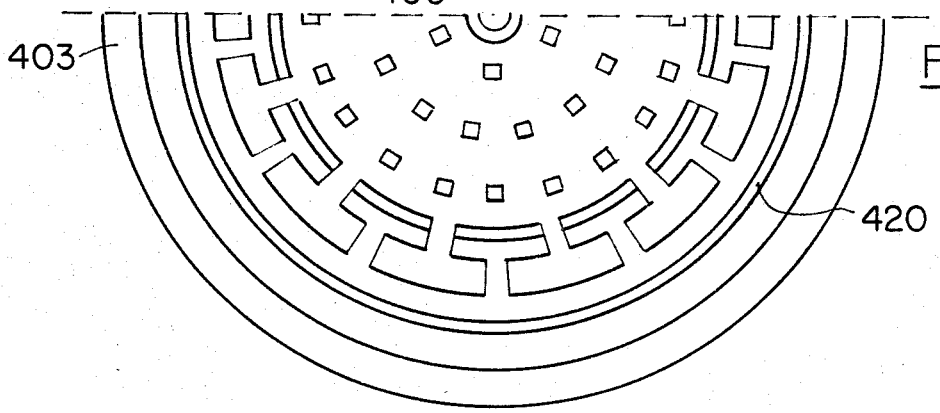
FIG. 6 is a partial bottom view of the aerator illustrated in FIG. 5.

FIG. 6, a bottom view of FIG. 5, shows the spout (403), the metal encasing (420) of the third tubular length (418), a plurality of the longitudinal ribs (424) as well as the curtains (426), and the prongs (428).

Examining the jet forming means (404), it is noted that a plurality of bridge elements (500) are provided. (Bridge elements (500') are also provided in the FIG. 2 and FIG. 4 embodiments). The bridge elements (500) may have various configurations as suggested by the embodiments disclosed above. As previously indicated the dimensions of the invention in the various embodiments are significant. In the FIG. 2 embodiment, in particular, the aerator (208) has the following preferable dimensions. The inner wall (246) preferably has an inner diameter of 19 mm, while the inner diameter of the longitudinal ribs (24) are 17.25 mm. The outer diameter of the shell (234) is preferably 17 mm, the thickness of the shell (234) being 0.2 mm. The jet forming means (230) has three rows of channels (472) at center-to-center distances of 4 mm, 9 mm, and 14 mm including 14 channels (472) in the outer row and 5 channels in the inner row. Entrance openings (470) to each channel (472) has a cross-section of 0.5 mm$\times$0.5 mm whereas the cross-section of each channel (472) is a constant 1 mm$\times$1 mm having, as previously noted, a length of 3.5 mm. The screen (236) has 40 wires per inch, each wire having a diameter of 0.01 inches. Preferably the screen (236) includes 2 layers separated from each other by 1 mm. With the above indicated dimensions, the totally concealed aerator (208) of FIG. 2 provides a rate of flow of 2.6 gallons per minute at 80 pounds back pressure, which conforms with the water saving regulations of various states in the United States.

Figure 8:
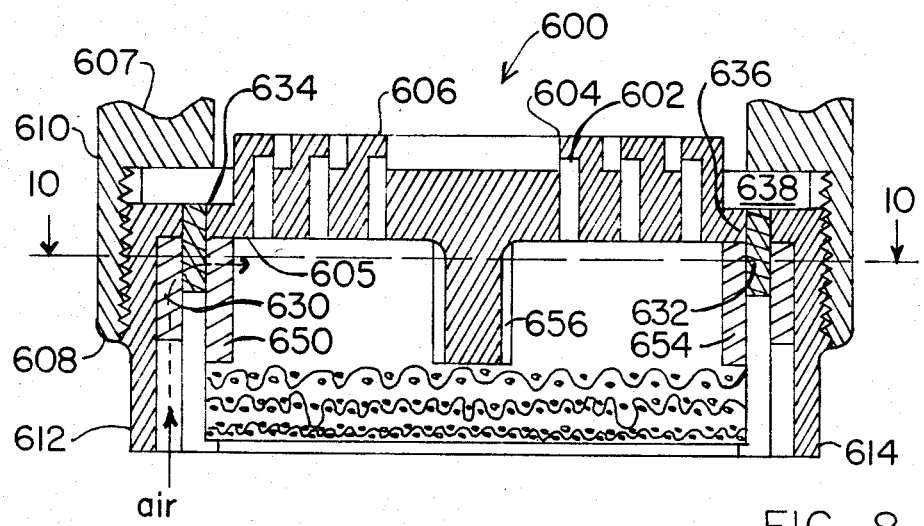
FIG. 8 is a front cutaway view of an embodiment of an aerator according to the invention.

Similarly, the embodiments shown in FIGS. 7 and 8 also conform to the appropriate state regulations standards when properly dimensioned. In the aerator of FIG. 7 for instance, the jet-forming disc (504) may have two rows of chambers aligned at center to center distances of 12.0 mm and 6.0 mm. In such a disc (504), a total of 16 chambers were provided, each of which had a cross section of 1.0$\times$1.0 mm. These chambers were each 2.0 mm high and were topped each by a bridge open on both sides, each entrance opening so formed being 0.6$\times$0.6 mm. Thus, an aerator of this invention, whether partially or entirely concealed, may embody such a disc have a second tubular length of a diameter of 16.00 mm or less and fit new as well as existing spouts.

Referring now to FIG. 7, a nearly entirely concealed aerator 502 is depicted. At the upstream end of the aerator 502 is a disc 504 having bridge elements 500" which open into apertures 506. Extending downstreamward from the disc 504 is an inner tubular member 510.

Specifically, member 510 includes an annular rim 512 which flares radially outwardly from the downstream-most portion 514 of the disc 504 and a plurality of ribs 516 which are angularly spaced about the axis 0. The ribs 516 circumscribe a chamber 518 into which water enters from the disc 504. The spaces between ribs 516 represent "windows" to the chamber 518.

Encircling the rim 512 and spaced radially outwardly therefrom is an outer tubular member 520. The outer tubular member 520 includes a male threaded ring 522 and a plurality of webs 524 protruding inwardly from the inner peripheral surface of the ring 522 at angularly spaced intervals. Preferably, the ring 522 has an inwardly bent flange portion 526 at its most upstream end. The male threaded ring 522 is shown to be complementary with the standard female threading of spout 530 at a downstream pipe portion 532 thereof. An upstream pipe portion 534 has a relatively reduced diameter, the upstream pipe portion 534 and downstream pipe portion 532 meeting at an annular shelf 538. Preferably, the shelf 538 lies in a plane orthogonal to the axis 0.

Examination of the space between the inner tubular member 510 and the outer tubular member 520 shows that the two members are coupled together by arcuate members 540 which have corresponding arcuate air spaces 542 therebetween. (See also arcuate members 630,632 and 642 of the FIG. 9 embodiment with air spaces c d a b therebetween). The arcuate members 540 and air spaces 542 extend downstream from the space between the rim 512 and flange 526 to an annular retaining element 546 for screens 548. The screens 548 are preferably 50×50 wires where each wire has a diameter of 0.009". The retaining element 546 is held between ribs 516 and webs 524.

To insert the aerator 502, a stem 550 is provided which can receive a coin 552. As the coin 552 advances from position 552' to 552", the aerator 502 screws into the spout 530. As this occurs, the upstream surface 560 of the flange 526 and the upstream surface 562 of the rim 512 press against a washer 564 which is sandwiched between said surfaces 560, 562 and the annular shelf 538. Preferably, the washer 564 is a flat rubber washer (as described in previous embodiments) and the upstream surfaces 560 and 562 preferably lie along a common plane which is orthogonal to the axis of the aerator 502 (shown as 0). In FIG. 7, the washer 564 seats against the outer peripheral surface of the disc 504 when the washer 564 is pressed against the shelf 538. This is preferable in that not only do the two upstream surfaces 560 and 562 make a seal but the disc 504 also forms a seal peripherally.

At this point, it may be noted that the washer 564 may be omitted if desired, thereby providing a direct dual seal of the upstream surfaces 560 and 562 against the shelf 538. In this variation it must be realized that the outer diameter of the rim 512 must exceed the diameter of the upstream pipe portion 534 so that the dual seal can be effected. This limitation is of course not a requirement where the washer 564 is provided.

A review of the aerator 502 of FIG. 7 shows that the openings 506 of the disc 504 are entirely upstream of the female threaded portion 532 of the spout 530.

The aerator 600 of FIG. 8 is similar to the FIG. 7 embodiment, except that the openings 602 are in three, rather than two concentric rows (of preferably 50 chambers, each chamber having a 0.6 mm×0.6 mm cross-section and a height of 2 mm); each opening 602 has a bridge element 604 which directs water into the disc 606 from only one side (having preferable opening dimensions of 0.6 mm width by 0.7 mm height); the openings 602 extend axially down to the rim 605 from the upstream pipe portion 607 to the downstream pipe portion 608 of the spout 610; and, rather than insertion by means of a coin, an axially extended outer tubular member 612 with knurled ends 614 is provided for screwing in the aerator 600. The screens in FIG. 8 are preferably 40×40 wires of 0.009" diameter because of the third screen. In this embodiment also, the outer row of openings has preferably 22 chambers, the middle 17, and the inner 11 at center-to-center distances of 14.5, 11, and 7 mm respectively.

Figure 9:
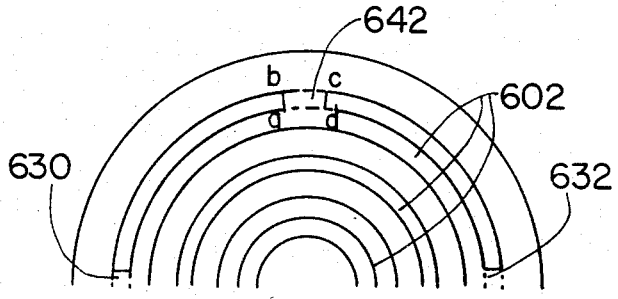
FIG. 9 is a partial top view and FIG. 10 is a section view along line 10—10 of FIG. 8.
Figure 10:
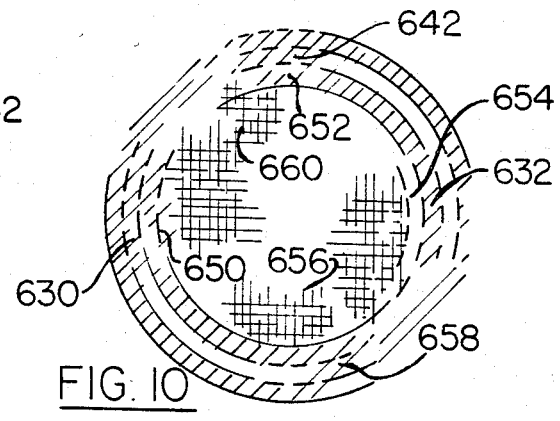

The embodiment of FIG. 8 is also depicted in FIGS. 9 and 10, FIG. 9 representing a partial top view and FIG. 10 representing a section view along line 10—10. In FIG. 9, three concentric rows of openings 602 are shown, together with arcuate spaces abcd positioned at angularly spaced intervals, 90° in FIG. 9. The upper end of webs 630 and 632 are shown in FIG. 8. When inserted into the spout 610, the upstream surface 634 of the flange 636 of the aerator 600 presses against a washer 638—the air spaces abcd between arcuate web members 630 and 642 and between arcuate web members 642 and 632 being sealed by the washer 638.

Turning now to FIG. 10, air is shown entering between web members, e.g. 630 and 642. Furthermore, ribs 650 through 656 are shown disposed radially inward from the web members 630, 642, 632, and 658 respectively. The ribs 650 through 656 hold the screen 660 in position.

In FIG. 11, 12, 13 and 14, a screen-holding tubular member 701 has a knurled skirt 702 which extends below the downstream end of the spout 720. Member 701 and skirt 702 may be chromium plated or made of plastic so treated as to appear metallic, if desired.

The skirt 702, upon easy rotation of a few degrees will fall down to the position shown in FIG. 12. The resulting 7 to 8 mm long tubular extension E below the end of the spout facilitates installing or removing the aerator 700. That is, after the screen holder 701 moves downward, to the FIG. 12 position, further rotation of the skirt 702 results in the unscrewing of the aerator 700. This screw or unscrewing can be done by using a tool, such as pliers. Preferably, however, a central stem into which a coin is insertable, as shown in FIG. 7, is provided to permit easy insertion and removal of the aerator 700 by use of a coin.

In the totally concealed aerator now in limited use, some people do not know how to remove it while others do not even realize there is an aerator inside the spout. These aerators are not threaded with the standard male threads having an outside diameter of 23.5 mm and said threads are not located near or at the downstream end of the aerator.

As shown in FIG. 11, the aerator 700 has jet-forming orifices 703. The screen holder 701 has three or four legs 705, each leg 705 projecting outwardly toward a tongue 706 which rests on top of a rib 707. When the screen holder 701 is rotated the tongue 706 disengages the rib 707 and falls onto ledge 710, as shown in FIGS. 12 and 13. FIG. 13 illustrates the top view of the aerator 700 in the absence of washer 715, whereas, FIG. 14 shows its bottom view in the absence of the screen holder 701. When the screen holder 701 is rotated anti-clockwise, the tongue 706 falls on ledge 710 and if it is further rotated anti-clockwise, the aerator 700 will unscrew as noted above. The aerator removal is achieved when twisting results in the tongue 706 pushing against a wall 732 on the aerator 700. During the insertion of the aerator 700 into the spout 730, the screen holder 701 is rotated clockwise and tongue 706 pushes on wall 737.

FIG. 15 illustrates a concealed aerator 799 which is inserted in and screwed on to the spout by means of a coin 800. One important feature of this aerator 799 is its small diameter upstream its male threads, so that it will enter within most standard female threaded spouts while its much larger downstream portion provides all the space needed for locating therein a large diameter screen element and providing air passageways as large as in conventional aerators. Another important feature is the provision of a stem 801 having an indent within which a coin 800, such as a quarter may be inserted for installing or removing the aerator 799 from the spout. The screen holding member is still another important feature of this aerator. The screen holding member comprises curtains 802 all of which, or only some of which as shown in FIG. 16 may be connected with webs 803 to the threaded annular member 804, an air passageway is shown as 805.

In this aerator 799, the tubular portion upstream the threads may be only 16 mm in diameter or smaller. Thus, in the United States where low rate of flow is required, only two rows of jet-forming orifices of the type shown in FIG. 11 by 703 may be used, permitting the decrease of the overall diameter of the aerator 799 upstream the threaded portion to a diameter of even less than 16 mm.

The greater rate of flow of the European aerator may require three rows of jet-forming orifices 806, 807, and 808. In such a case, the diameter may be increased to 16 mm to permit insertion of the aerator into most female standard threaded spouts.

It will be noted that the air passageway 805 may be closed at 809 as shown, or open as shown at 810, according to molding requirements. When they are closed, webs 803 may be done away with, if desired. In the latter case, the sealing is effected by washer 811.

The screen 812 is held in position by lips 813, prongs 814 and ribs 815, which help keep them in position.

Fully bubble-saturated streams are produced when the jet-forming disc comprised two rows of chambers at 6 and 12 mm center-to-center distances. The chambers are 2 mm high and have a cross section of $1.0\times1.0$ mm, and each entrance opening upstream the chambers measures $0.6\times0.6$ mm. The number of the resulting water passageways was sufficient to deliver 2.5 GPM at 80 LBS back pressure, in compliance with the California regulations.

An equally bubble-saturated stream is produced from aerators designed to meet the European flow decibel requirements, where center-to-center distances of the chambers were 7, 10, 14 mm, respectively, with about 48 chambers each having a cross-section of $0.6\times0.6$ mm and an entrance opening of 0.6 a 0.7 mm.

Other improvements, modifications and embodiments will become apparent to one of ordinary skill in the art upon review of this disclosure. Such improvements, modifications and embodiments are considered to be within the scope of this invention as defined by the following claims.

I claim to have invented:

1. An improved tubular aerator for insertion into a spout through which water flows, the spout having (a) a downstream pipe portion with standard female threading along the inner surface thereof, the smallest diameter of the female threading being $d_1$; (b) an upstream pipe portion which (i) has a common longitudinal axis with and is axially adjacent to the downstream pipe portion and (ii) has an inner diameter $d_2$ which is less than $d_1$; and (c) an annular shelf extending between the inner surface of the upstream pipe portion and the inner surface of the downstream pipe portion, the improved aerator comprising:

a disk of diameter less than $d_2$ having at least one aperture therein through which water can flow;

an annular rim extending radially outward from a downstream part of said disk;

a body portion extending downstream from said rim, said body portion having air inlets defined therein and defining a chamber downstream from said disk;

a ring with male threading complementary with the spout threading encircling said rim, said ring being spaced radially outward from said rim;

means for coupling said ring to said rim maintaining an air space therebetween which extends downstreawardly about said body portion around at least an arcuate length thereof, the air space defining a passageway for air into the chamber through the air inlets; and means for producing a seal against the upstream surface of said rim and the upstream surface of said ring to close off the upstream end of the air space therebetween when the aerator is screwed into the spout;

said seal producing means acting to confine the flow of air and the flow of water into the chamber;

said disk at least partially extending up into the upstream pipe portion when the aerator is screwed into the spout, the aerator thereby being at least partially concealed.

2. An aerator according to claim 1 wherein said seal producing means includes a washer which rests against both the upstream surface of said rim and the upstream surface of said ring;

said washer being pressed between (a) the annular shelf of the spout and (b) both the upstream surface of said rim and the upstream surface of said ring when the aerator is screwed into the spout.

3. An aerator according to claim 2 wherein the outer diameter of said rim is greater than $d_2$ and less than $d_1$.

4. An aerator according to claim 1 wherein the outer diameter of said rim is greater than $d_2$ and less than $d_1$ and wherein the upsteam surface of said rim and the upstream surface of said ring sealedly abut the annular shelf of the spout when the aerator is screwed into the spout;

said seal producing means thereby comprising the upstream surface of said ring and the upstream surface of said rim when pressed against the annular shelf.

5. An aerator according to claim 3 wherein said body portion includes:

a plurality of ribs, each rib extending in the downstream direction from said rim, said ribs being spaced at angular intervals and circumscribing the chamber;

a plurality of axially extending webs protruding radially inwardly from the inner peripheral surface of said ring, said webs being spaced at angular intervals about the inner peripheral surface of said ring to encircle said ribs;

at least one screen; and annular means for retaining said at least one screen at a position downstream from said disk, said annular means being suspended from and between said webs and said ribs at downstream ends thereof;

the air space defined between said ring and said rim extending downstreamwardly between said webs and said ribs, terminating at said annular means;

wherein said webs have arcuate air gaps therebetween into which air flows enroute to the air space between said webs and said ribs and wherein said ribs have arcuate windows therebetween through which air from the air space enters the chamber to aerate water entering the chamber through said disk.

6. An aerator according to claim 1 wherein said body portion includes:

a plurality of ribs, each rib extending in the downstream direction from said rim, said ribs being spaced at angular intervals and circumscribing the chamber;

a plurality of axially extending webs protruding radially inwardly from the inner peripheral surface of said ring, said webs being spaced at angular intervals about the inner peripheral surface of said ring to encircle said ribs;

at least one screen; and annular means for retaining said at least one screen at a position downstream from said disk, said annular means being suspended from and between said webs and said ribs at downstream ends thereof;

the air space defined between said ring and said rim extending downstreamwardly between said webs and said ribs, terminating at said annular means;

wherein said webs have arcuate air gaps therebetween into which air flows enroute to the air space between said webs and said ribs and wherein said ribs have arcuate windows therebetween through which air from the air space enters the chamber to aerate water entering the chamber through said disk.

7. An aerator according to claim 6 wherein the annular means is positioned to retain at least one of said screens upstream from downstreammost portion of male threading on said ring, the aerator being substantially concealed by the spout.

8. An aerator according to claim 1 wherein the aerator comprises:

a transparent plastic with metal interspersed therein.

9. An aerator according to claim 2 wherein the annular shelf lies in a plane orthogonal to the spout axis;

wherein said washer is flat; and wherein the upstream surface of said ring and the upstream surface of said rim lie in a common plane orthogonal to the aerator axis.

10. An aerator according to claim 3 wherein said coupling means includes a plurality of arcuate members extending between said ribs and said webs, the space between arcuate members forming the air space which extends downstreamwardly from between said ring and said rim.

11. An aerator according to claim 1 wherein said coupling means includes a plurality of arcuate members extending between said ribs and said webs, the space between arcuate members forming the air space which extends downstreamwardly from between said ring and said rim.

12. An aerator according to claim 3 wherein said ring includes an annular flange at the upstream end thereof which extends radially inwardly toward said rim; and wherein said coupling means includes a plurality of arcuate members extending between said flange and said rim at angular intervals, the spacing between said arcuate members defining the air space between said ring and said rim.

13. An aerator according to claim 1 wherein said ring includes an annular flange at the upstream end thereof which extends radially inwardly toward said rim; and wherein said coupling means includes a plurality of arcuate members extending between said flange and said rim at angular intervals, the spacing between said arcuate members defining the air space between said ring and said rim.

14. An aerator according to claim 12 wherein said washer is dimensioned to seal against the outer peripheral surface of said disk when the aerator is screwed into the spout.

15. An aerator according to claim 2 wherein said washer is dimensioned to seal against the outer peripheral surface of said disk when the aerator is screwed into the spout.

16. An improved tubular aerator for insertion into a spout through which water flows, the spout having (a) a downstream pipe portion with standard female threading along the inner surface thereof, the smallest diameter of the female threading being $d_1$; (b) an upstream pipe portion which (i) has a common longitudinal axis with and is axially adjacent to the downstream pipe portion and (ii) has an inner diameter $d_2$ which is less than $d_1$; and (c) an annular shelf extending between the inner surface of the upstream pipe portion and the inner surface of the downstream pipe portion, the improved aerator comprising:

a disk dimensioned to fit into the upstream pipe portion, said disk having apertures therein through which water flows;

an inner tubular member extending downstream from said disk with a larger outer diameter than said disk and defining a chamber therein, said inner tubular member having windows defined therein at angular intervals therearound;

an outer tubular member having male threads thereabout that are complementary with the spout threading and air channels defined therein, said outer tubular member and said inner tubular member being spaced apart;

means for coupling together said inner tubular member and outer tubular member into a single structure;

said inner tubular member having an upstream surface and said outer tubular member having an upstream surface; and means for producing a seal between the upstream surface of said inner tubular member and the annular shelf of the spout and for producing a seal between the upstream surface of said outer tubular member and the annular shelf of the spout upon aerator insertion;

wherein air enters the chamber through the air channels in said outer tubular member and passes through the space between said inner tubular member and said outer tubular member, thereafter flowing into the chamber through the windows in said inner tubular member and wherein said aerator is at